US009192985B2

(12) United States Patent
Bremmer et al.

(10) Patent No.: US 9,192,985 B2
(45) Date of Patent: Nov. 24, 2015

(54) REMOVABLE PASSAGE MANDREL

(71) Applicant: Sikorsky Aircraft, Stratford, CT (US)

(72) Inventors: Jonathan Bremmer, Glastonbury, CT (US); Shihong G. Song, Cheshire, CT (US); Jeffrey G. Sauer, Woodbury, CT (US); James S. Giampapa, Oxford, CT (US)

(73) Assignee: SIKORSKY AIRCRAFT CORPORATION, Stratford, CT (US)

( * ) Notice: Subject to any disclaimer, the term of this patent is extended or adjusted under 35 U.S.C. 154(b) by 127 days.

(21) Appl. No.: 14/047,559

(22) Filed: Oct. 7, 2013

(65) Prior Publication Data

US 2015/0096711 A1 Apr. 9, 2015

(51) Int. Cl.

| | |
|---|---|
| ***B22C 9/10*** | (2006.01) |
| ***B22C 9/24*** | (2006.01) |
| ***B22D 29/00*** | (2006.01) |
| ***B22D 25/02*** | (2006.01) |

(52) U.S. Cl.

CPC . *B22C 9/10* (2013.01); *B22C 9/103* (2013.01); *B22C 9/24* (2013.01); *B22D 25/02* (2013.01); *B22D 29/001* (2013.01)

(58) Field of Classification Search

CPC ..... B22C 9/10; B22C 9/103
USPC ..... 164/23, 369
See application file for complete search history.

(56) References Cited

U.S. PATENT DOCUMENTS

| | | | | |
|---|---|---|---|---|
| 2,045,556 | A * | 6/1936 | Almen | 249/62 |
| 2,991,520 | A | 7/1961 | Dalton | |
| 3,945,429 | A | 3/1976 | Wahlqvist | |
| 4,532,974 | A | 8/1985 | Mills et al. | |
| 4,637,449 | A | 1/1987 | Mills et al. | |
| 5,201,357 | A | 4/1993 | Kuhn et al. | |
| 6,024,159 | A | 2/2000 | Woycik et al. | |

FOREIGN PATENT DOCUMENTS

JP 57085638 A * 5/1982

OTHER PUBLICATIONS

S.G. Song, et al. "Quasi-self Destructive Core for Investment Casting" co-pending patent U.S. Appl. No. 13/747,653, filed Jan. 23, 2013.

* cited by examiner

*Primary Examiner* — Kevin E Yoon
(74) *Attorney, Agent, or Firm* — Cantor Colburn LLP

(57) ABSTRACT

A composite core for forming a passage in an investment casting mold is provided including a core element. A generally hollow structural element is positioned about an exterior of the core element. The structural element is configured to deform when a force is applied to the structural element. A rigid shell element is integrally formed about the structural element. The shell element is configured to break when the structural element deforms.

16 Claims, 6 Drawing Sheets

REMOVABLE PASSAGE MANDREL

BACKGROUND OF THE INVENTION

Exemplary embodiments of the invention generally relate to investment casting, and more particularly, to a core for forming a passage in an investment casting mold.

Investment casting is a commonly used technique for forming metallic components having complex shapes and geometries. especially hollow components such as those used in aerospace applications for example. The production of an investment cast part generally involves producing a ceramic casting mold having an outer ceramic shell with an inside surface corresponding to the shape of the part, and one or more ceramic cores positioned within the outer ceramic shell, corresponding to interior passages to be formed within the part. Molten alloy is introduced into the ceramic casting mold and is then allowed to cool and to harden. The outer ceramic shell and ceramic core(s) are then removed to reveal a cast part having a desired external shape and hollow interior passages in the shape of the ceramic core(s).

In comparison to other processes, for example sand casting or permanent mold casting, investment casting provides flexibility while maintaining tight tolerances. In particular, controlled solidification investment casting (CSIC) uses rapid directional cooling to enhance microstructure and mechanical properties. CSIC, therefore, may be useful for an expanded range of applications, particularly in the aerospace industry. However, investment casting is limited by the design of passages within the mold. Unlike a sand core used in a sand casting process, the ceramic cores used in CSIC are difficult to remove or destroy without affecting the molded part. As a result, the process of designing passages severely restricts the use of CSIC for applications requiring complex cored passages.

BRIEF DESCRIPTION OF THE INVENTION

According to one embodiment of the invention, a composite core for forming a passage in an investment casting mold is provided including a core element.

A generally hollow structural element is positioned about an exterior of the core element. The structural element is configured to deform when a force is applied to the structural element. A rigid shell element is integrally formed about the structural element. The shell element is configured to break when the structural element deforms.

According to one embodiment of the invention, a method for manufacturing a composite core for forming a passage in an investment casting mold is provided including arranging a core element adjacent an interior surface of a generally hollow structural element. The shape of the coupled core element and structural element is adjusted to that of the passage. Slurry having particles of varying sizes is layered about the structural element. The slurry is cured to form a rigid shell element.

According to yet another embodiment of the invention, a method for forming a passage in a cast component is provided including arranged a composite core into an interior of a mold. The composite core includes a core element coupled to a structural element and a shell element formed integrally with the structural element. Material of the component is pouring into the mold. The material to form the component is cured and a force is applied to a first exposed portion of the composite core such that core element slides relative to the composite core. A force is applied to a second exposed portion of the composite core such that the structural element deforms inside the component, so as to break the shell element.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
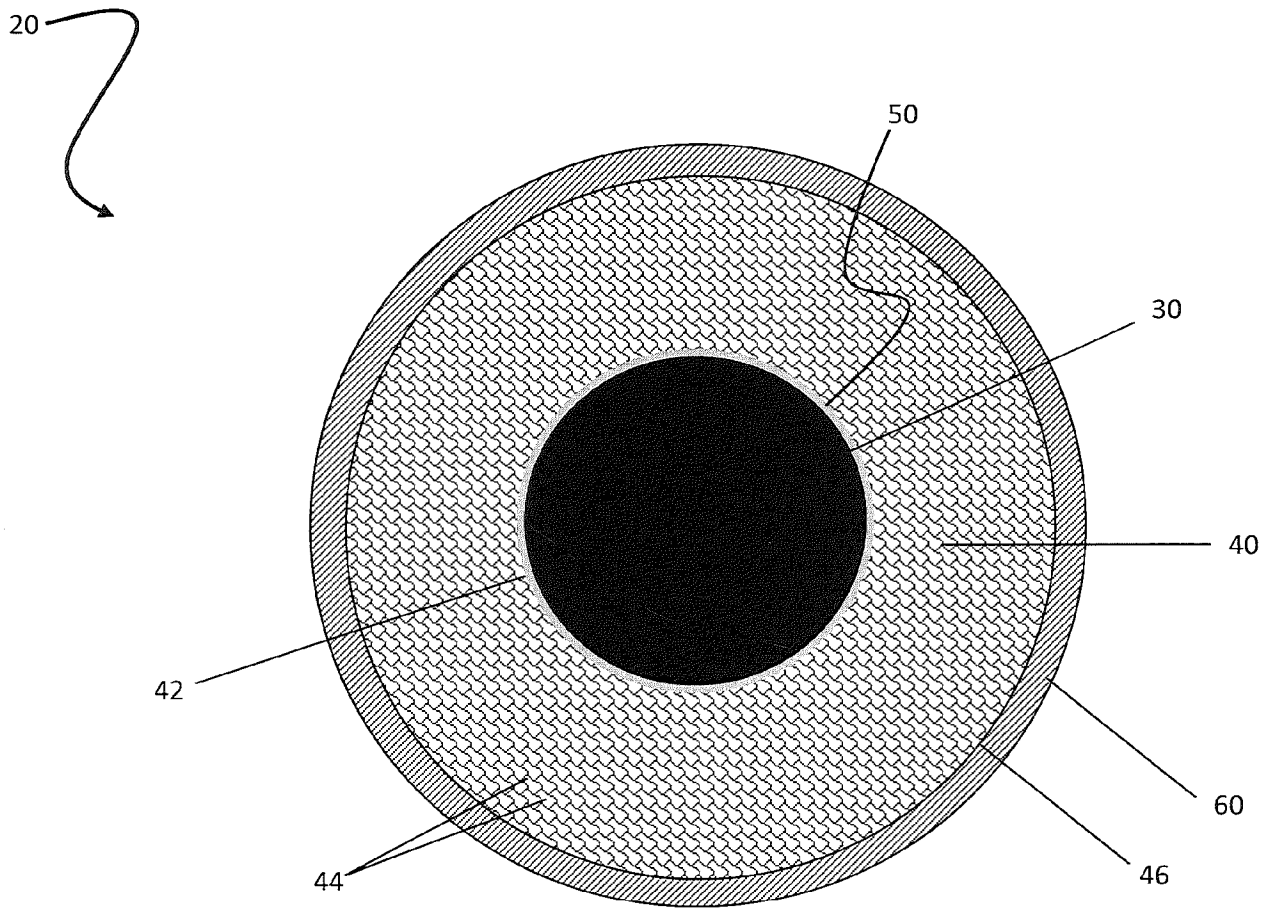
FIG. 1 is an end view of a composite core according to an embodiment of the invention.
Figure 2:
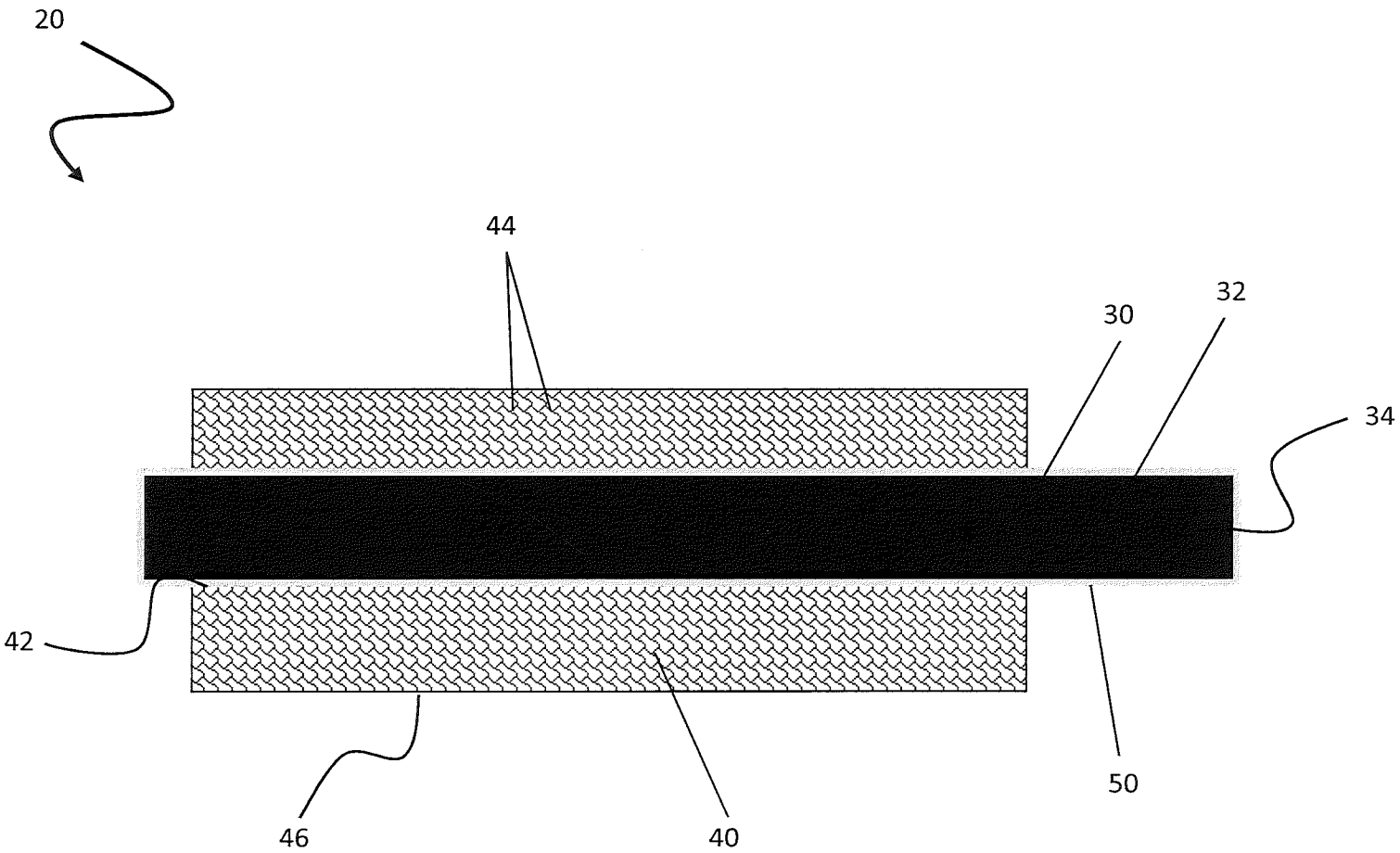
FIG. 2 is a cross-sectional view of a portion of a composite core according to an embodiment of the invention.

The detailed description explains embodiments of the invention, together with advantages and features, by way of example with reference to the drawings.

DETAILED DESCRIPTION OF THE INVENTION

With reference now to the FIGS., a composite core 20 configured to form a substantially hollow passage in an investment casting mold is provided. Arranged at the center of the composite core 20 is a core element 30, such as a metal rod or wire (i.e. a CRES wire) for example. The core element 30 may be formed from any strong, malleable, semi-rigid material such that the contour of the core element 30 is adjustable to achieve various shapes and configurations. In one embodiment, the material of the core element 30 is similar to the material of the component being cast. Exemplary metallic materials include, but are not limited to, steel, copper, and nickel for example.

Positioned about the exterior 32 and extending along the length of the core element 30, excluding the first end 34, is a hollow structural element 40. The structural element 40 may be pre-formed such that the core element 30 is inserted into a hollow center (not shown) thereof, or alternatively, the structural element 40 may be formed around the exterior 32 of the core element 30.

The structural element 40 includes a plurality of openings 44 configured to allow air to pass there through. In one embodiment, the tubular structural element 40 includes a metallic wire mesh. In another embodiment, the structural element 40 is formed by braiding a plurality of wires together to form a braided metallic material. The braided metallic material may, but need not be uniform over the length of the structural element 40 such that the openings 44 formed therein need not be evenly spaced or equal in size. The specifications of the wires used to form the structural element 40 may be selected to facilitate contact between the structural element 40 and the core element 30, as well as the ultimate breakdown of the composite core 20. As a result, the cross-section of the wires may be any of a variety of shapes, such as circular, square, triangular, or trapezoidal for example. As illustrated, an outer dimension of the structural element 40 is substantially similar to the general size of the passage to be formed within an investment casting mold. The structural element 40 may include one or more layers of mesh or braided wire to achieve the desired dimensions of the passageway. While shown with openings 44, it is understood that the use of such openings 44 is not required in all aspects.

The structural element 40 is generally flexible such that it may be contoured to achieve a variety of shapes and configurations identical to those of the core element 30. In addition, the structural element 40 is also configured to deform by either stretching or compressing about its length. Considerations for the strength and ductility of the wires used to form the structural element 40 include the ability of the structural element 40 to support itself, the ability of the structural element 40 to support the composite core 20 once the shell element 60 is formed, and the ability of the structural element 40 to deform when a force is applied to the core element 30 coupled thereto.

A material 50, such as a dry film or powdered material for example, is positioned between the outside 32 of the core element 30 and the inside 42 of the structural element 40. In one embodiment, this material 50 is a lubricant configured to slidably couple the core element 30 and the structural element 40 such that a when a force is applied to the core element 30, the core element 40 slides relative to the structural element 40 so as to ease insertion of the core element 30 into the structural element 40. In another embodiment, the material 50 is an adhesive such that the force is transferred to the structural element 40 as well. In some instances the material 50 may extend beyond the interior surface 42 and into a portion of the thickness of the structural element 40. In addition, the material 50 may need to dry or cure to strengthen the bond between the structural and core elements 40, 30.

The composite core 20 additionally includes a shell element 60 arranged about the exterior 46 of the structural element 40. A force applied to the structural element 40 transfers to the shell element 60, thereby causing the shell element 60 to crack and/or break. Where the material 50 is an adhesive, such transfer could be from the core element 30. The strength of the wire and the size of the openings 44 of the structural element 40 are selected to support the shell element 60 as it is formed about the structural element 40.

Figure 3:
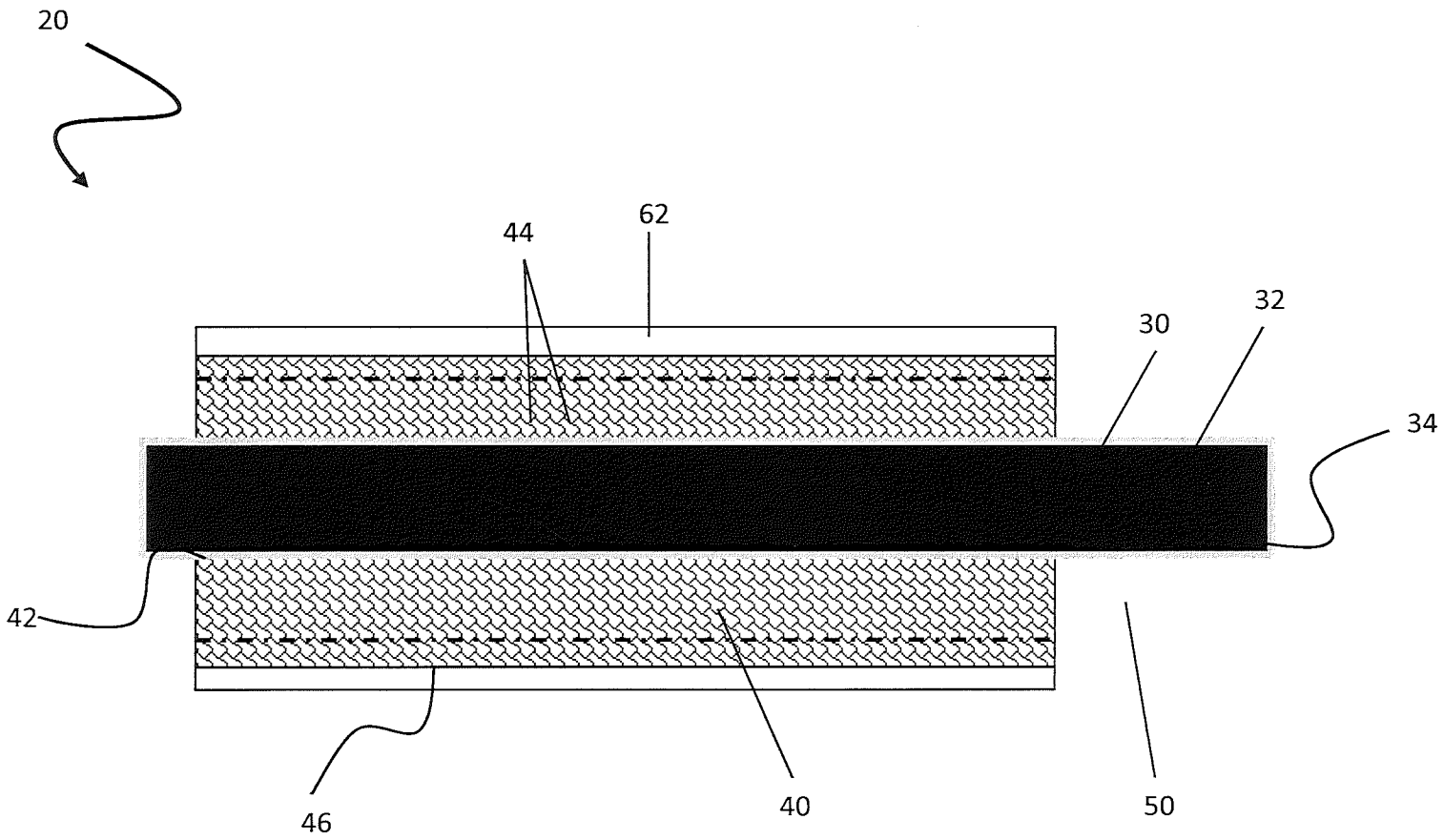
FIG. 3 is cross-sectional view of a composite core including layers of slurry according to an embodiment of the invention.

After the core element 30, structural element 40, and material 50 are assembled and contoured to a desired shape, the outer shell element 60 is formed, for example through a shelling process. The exterior surface 46 of the structural element 40 is coated with a slurry 62 having particles of varying sizes. In one embodiment, the material of the slurry 62 used to form the outer shell 60 is substantially identical to the material used to form the investment casting mold, such as ceramic for example. Alternatively, the material of the slurry 62 may be modified to facilitate breakdown of the outer shell 60 when a force is applied to the element 40. In one embodiment, illustrated in FIG. 3, the slurry 62 may be arranged in a plurality of layers beginning generally within a portion of the thickness of the structural element 40 and extending outwardly therefrom such that the structural element 40 and the shell element 60 are integrally formed.

After layering the slurry 62 about the structural element 40, the slurry 62 is hardened, such as by firing the composite core 20 in an oven or kiln for example. Heat causes the slurry 62 to strengthen and solidify into a cured, rigid, shell element 60. When the composite core 20 is formed, the outer surface 64 of the shell element 60 may be substantially uniform, or alternatively, may include slight variations, such as waves or grooves for example.

Figure 4:
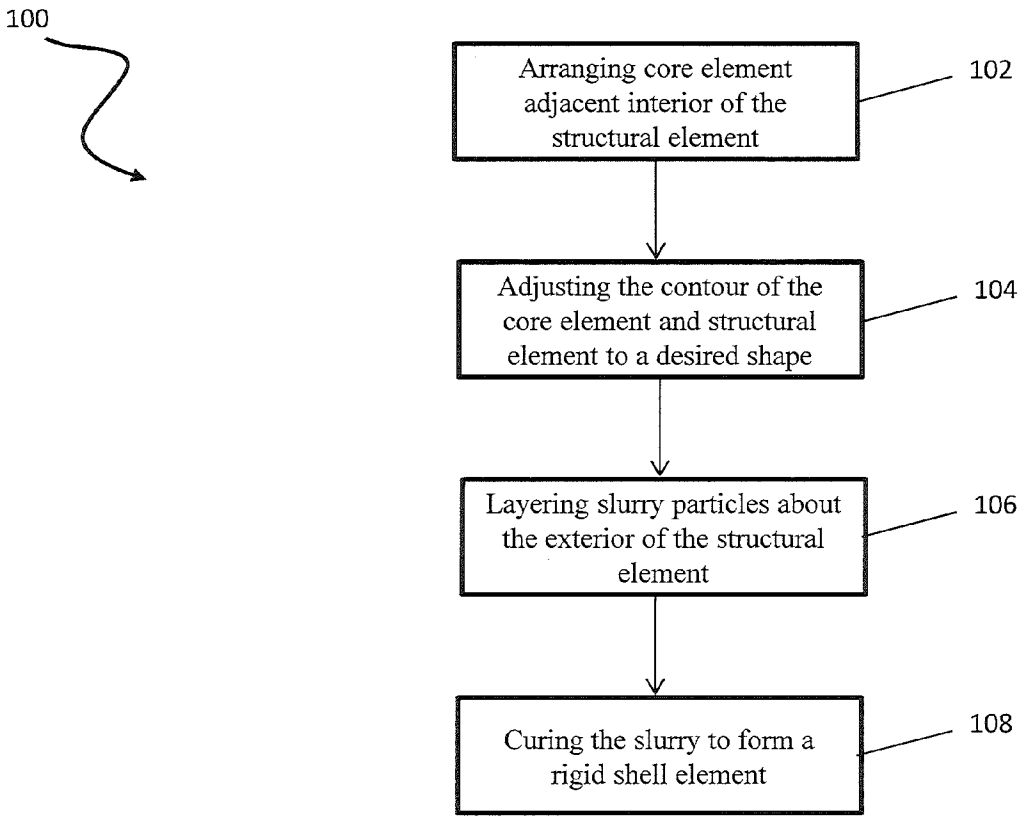
FIG. 4 is a block diagram of a method of manufacturing a composite core according to an embodiment of the invention.

A method 100 for manufacturing a composite core 20 for forming a passage in an investment casting mold is illustrated in FIG. 4. In block 102, the core element 30 is arranged adjacent the interior surface 42 of the structural element 40. The material 50 is disposed between the core element 30 and the interior surface 42 to ease the insertion of the core element 30 into the structural element 40. Once in position, together both the core element 30 and the structural element 40 are contoured to a desired shape of the passage to be formed, as shown in block 104. In block 106, one or more layers of slurry 62 are poured about the exterior 46 of the structural element 40. The slurry 62 is cured in block 108 to form the rigid outer shell 60 of the composite core 20.

Figure 5:
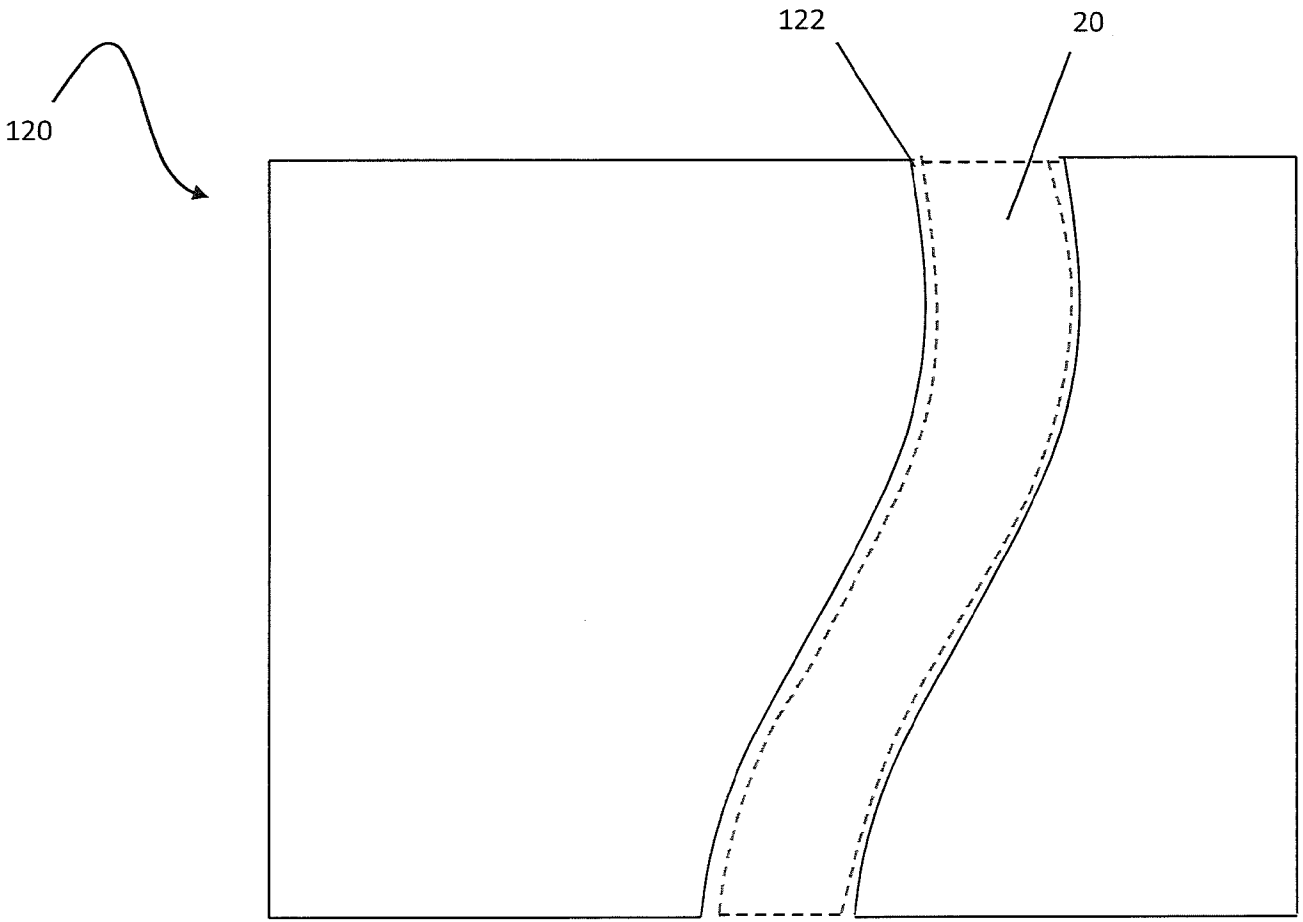
FIG. 5 is a cross-sectional view of a component formed from an investment casting mold having a passage formed by a composite core according to an embodiment of the invention.

Referring now to FIG. 5, a component 120 formed using an investment casting mold and at least one composite core 20 is illustrated. To remove the composite core 20 from a passageway 122 of the component 120, a force is applied to an exposed end 34 of the core element 30, causing the core element 30 to slide relative to the structural element 40, and out of the core 20. A force is next applied to the structural element 40. Because the shell element 60 is formed about the structural element 40, deformation thereof causes the brittle shell element 60 to shatter and break away from wire of the structural element 40. Any remaining pieces of the shell element 60 may then be easily removed from the passage 122 of the component 120, for example using water expelled at a high pressure.

Figure 6:
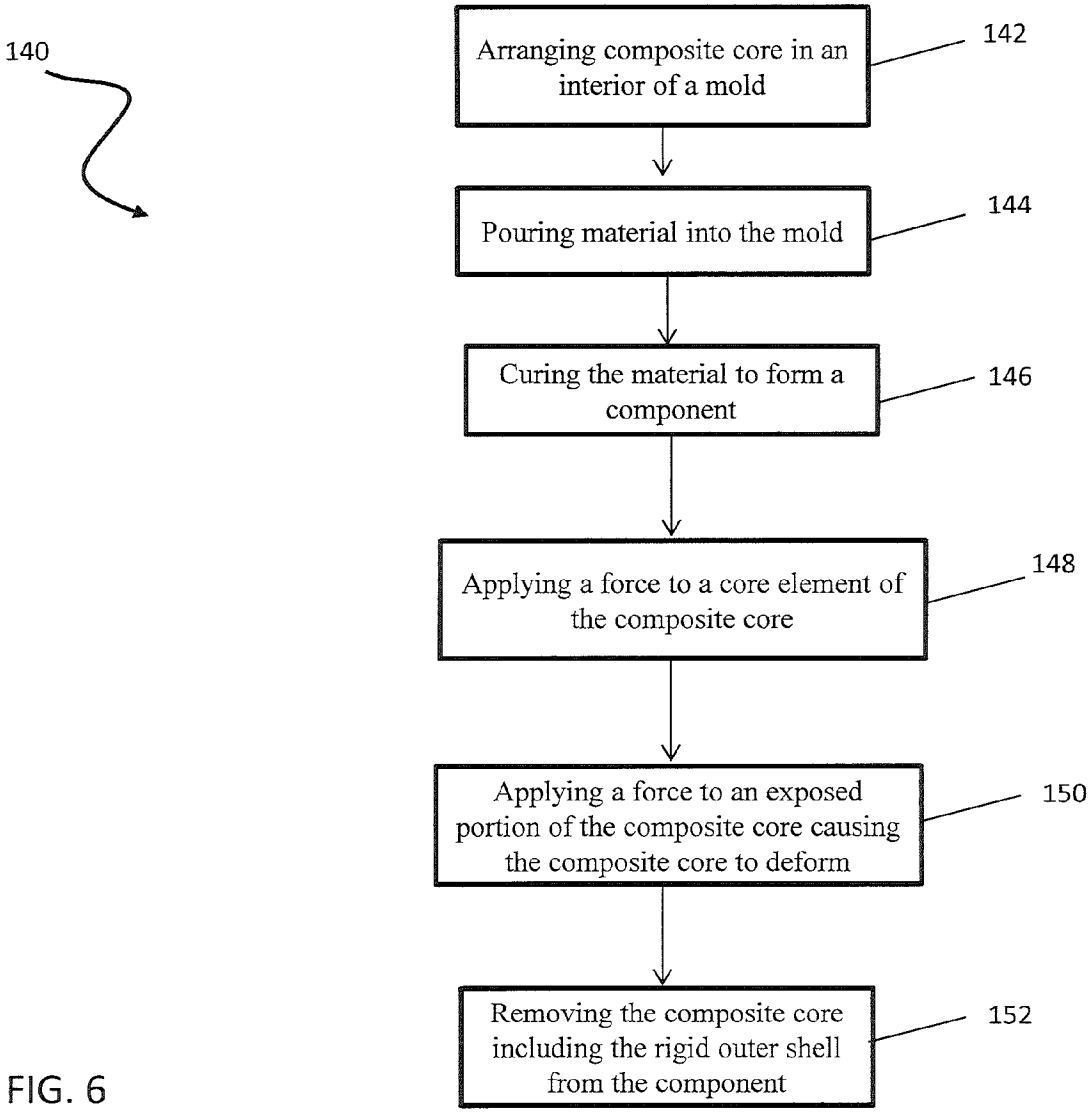
FIG. 6 is a block diagram of a method of forming a passage in an investment cast component according to an embodiment of the invention.

A method 140 of forming a component 120 having a passageway 122 is illustrated in FIG. 6. In block 142, a composite core 20 having the size and shape of the desired passageway is inserted into the interior of a mold. The material to form the component 120 is poured into the mold in block 144 and is cured to form the component 120 in block 146. In block 148, a force is applied to an exposed portion of the composite core 20, such as the end 34 of the core element 30 for example. In block 150, a force is then applied to another exposed portion of the composite core 20, such as the structural element for example. This force causes the composite core 20 to deform within the component 120 and separate therefrom. The composite core 20 including the rigid outer shell 60 is then removed from the component 120 in one or more pieces as illustrated in block 152.

The composite core 20 may be constructed to create a complex cored passage within an investment casting mold, thereby expanding the range of applications to which controlled solidification investment casting (CSIC) may be applied. Further, by incorporating waves or grooves into the outer surface 64 of the shell element 60, the passage 82 can have specific patterns such as rifling. The rapid and directional solidification of the investment casting process will result in high quality castings having enhanced microstructures. Because a significant portion of the CSIC process is automated, more stringent quality control measures may be implemented to improve and stabilize the casting process. Forming parts that were previously too complex using a CSIC process will reduce both scrap rates and production cycle time.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A composite core for making a passage in an investment casting mold comprising:

a core element;

a generally hollow structural element positioned about an exterior of the core element, the structural element being configured to deform when a force is applied to the structural element;

a rigid shell element integrally formed about the structural element, the shell element being configured to break when the structural element deforms; and a material that extends from an exterior surface of the core element to at least an interior surface of the structural element.

2. The composite core according to claim 1, wherein the structural element includes a plurality of openings such that air is configured to pass there through.

3. The composite core according to claim 2, wherein the structural element includes one of more layers of a wire mesh material.

4. The composite core according to claim 2, wherein the structural element includes one of more layers of a braided wire material.

5. The composite core according to claim 1, wherein both the core element and the structural element are semi-rigid and may be contoured to any of a variety of shapes and configurations.

6. The composite core according to claim 1, wherein a dimension of the structural element is generally the same size as the passage being formed.

7. The composite core according to claim 1, wherein the shell element is formed by arranging multiple layers of slurry having particles of varying sizes, and curing the layers of slurry to form the rigid shell element.

8. The composite core according to claim 7, wherein a material of the slurry is substantially identical to a material of the investment casting mold.

9. The composite core according to claim 7, wherein the material of the slurry is generally ceramic.

10. The composite core according to claim 1, wherein the material is a lubricant.

11. A method for manufacturing a composite core for forming a passage in an investment casting mold comprising:

arranging a core element adjacent an interior surface of a generally hollow structural element;

adjusting a shape of the coupled core element and structural element to that of the passage;

layering slurry having particles of varying sizes about the structural element;

curing the slurry to form a rigid shell element; and disposing a material between the core element and the structural element.

12. The method according to claim 11, wherein the material extends beyond the interior surface and into a portion of the thickness of the structural element.

13. The method according to claim 11, wherein the slurry extends from adjacent a portion of a thickness of the structural element to beyond an exterior surface of the structural element.

14. The method according to claim 11, wherein the core element is inserted into a generally hollow center of the preformed structural element.

15. The method according to claim 11, wherein the structural element is formed about the exterior of the core element.

16. A method for forming a passage in a cast component comprising:

arranging a composite core into an interior of a mold, wherein the composite core includes a core element arranged within a structural element, and a shell element formed integrally with the structural element; disposing a material between the core element and the structural element;

pouring material of the component into the mold;

curing the material to form the component;

applying a force to a first exposed portion of the composite core such that the core element separates from the composite core; and applying a force to a second exposed portion of the composite core such that the structural element deforms inside the component so as to break the shell element.

* * * * *